United States Patent [19]

Ikemura

[11] 4,066,284

[45] Jan. 3, 1978

[54] LATCH FOR WINDOWS OR DOORS

[75] Inventor: Akio Ikemura, Kurobe, Japan

[73] Assignee: Yoshida Kogyo Kabushiki Kaisha, Tokyo, Japan

[21] Appl. No.: 624,891

[22] Filed: Oct. 22, 1975

[30] Foreign Application Priority Data

Oct. 22, 1974 Japan ..... 49-128270[U]

[51] Int. Cl.[2] ..... E05C 5/02

[52] U.S. Cl. ..... 292/62; 292/DIG. 46; 292/DIG. 60

[58] Field of Search ..... 292/57–69, 292/DIG. 60, DIG. 46; 70/460

[56] References Cited

U.S. PATENT DOCUMENTS

| | | | |
|---|---|---|---|
| 408,228 | 8/1889 | Fitch et al. | 292/57 |
| 849,072 | 4/1907 | Jeffers | 292/60 |
| 961,778 | 6/1910 | John | 292/57 |
| 1,571,012 | 1/1926 | Keuser, Sr. | 292/58 X |
| 1,693,158 | 11/1928 | Reinicke et al. | 292/60 |
| 3,397,000 | 8/1968 | Nakanishi | 292/62 X |

*Primary Examiner*—Richard E. Moore

*Attorney, Agent, or Firm*—Hill, Gross, Simpson, Van Santen, Steadman, Chiara & Simpson

[57] ABSTRACT

A latch of the bolt type for use with windows or doors includes a plate member disposed slidably within a latch housing and has engaging means thereon for engaging with the handle of a latch bolt to hold the latter in its extended position. The plate member can be moved in a direction in which the latch bolt is slidable and can be secured relative to the housing by means of a screw, whereby the length of projection of the latch bolt is made variable.

6 Claims, 6 Drawing Figures

LATCH FOR WINDOWS OR DOORS

BACKGROUND OF THE INVENTION

1. Field of the Invention

This invention relates generally to latches and more particularly to an improved latch of the bolt type for use with windows or doors.

2. Prior Art

As is well known in the art, conventional latches of the type described were each provided with a housing mounted on the interior side of a door or window sash and a latch bolt supported slidably in the housing and adapted to protrude into a recess formed in or a staple fixed to an outer frame of the door or window. The latch bolt was moved in its longitudinal direction by manipulating a handle which is secured to and extends at substantially right angles to the latch bolt, and was held in its extended position by engaging the handle with an engaging prong secured to the housing. Therefore, the prior art latches were provided with the latch bolts having fixed projections and this has led to the drawback that the latches must have such respective bolt projections that are designed to meet with various gaps between the bottom rails of sliding doors or window sashes and the outer fixed frames in which they are mounted.

SUMMARY OF THE INVENTION

With the prior art drawback in mind, this invention has for its object to provide an improved latch of the bolt type which has a latch bolt of a variable projection capable of adapting itself to different gaps between the bottom rails and outer fixed frames of windows or doors.

Briefly stated, the invention provides a latch of the bolt type for use with windows or doors comprising a housing having an opening formed therein; a latch bolt slidably supported in said housing and having a handle extending at substantially right angles to the latch bolt, said handle projecting through said opening; a plate member having engaging means thereon for engaging with said handle and disposed within said housing, said plate member being movable in a direction in which said latch bolt is slidable; and said latch bolt being held in its extended position when said handle engages said engaging means.

Other objects and advantages of the invention will become more apparent from the following description taken in conjunction with the accompanying drawing illustrating a preferred embodiment which the invention may assume in practice.

DETAILED DESCRIPTION OF THE PREFERRED EMBODIMENT

Figure 1:
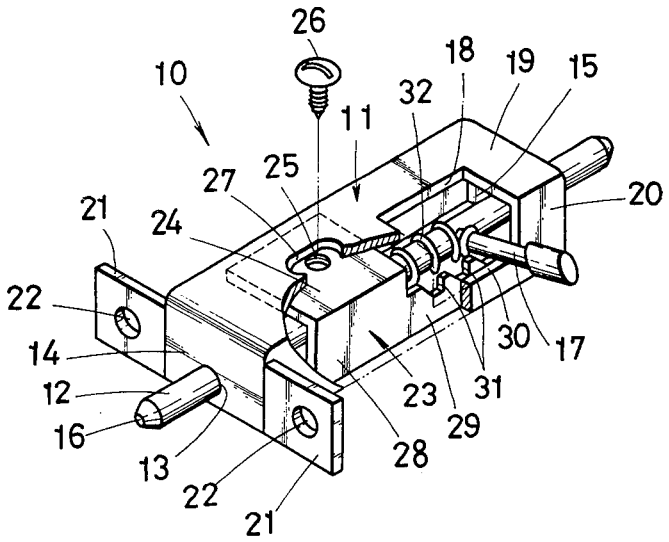
FIG. 1 is an enlarged perspective view, partially cut away, of a latch constructed according to the invention.

Referring now to the drawing and to FIG. 1 in particular, there is shown a latch assembly of the bolt type generally designated at 10 which is constructed in accordance with the invention. The latch assembly 10 broadly comprises a housing 11 of an elongated structure and a latch bolt 12 supported slidably in the housing 11 and extending along and beyond the length of the housing 11 through holes 13 formed through opposed front and rear walls 14 and 15. The latch bolt 12 has its front end 16 extending beyond the wall 14 and is provided with a handle 17 extending at substantially right angles to the latch bolt 12. The handle 17 projects outwardly from the housing 11 through an opening 18 which is formed in a pair of adjacent walls 19 and 20 of the housing 11. The opening 18 should be of such dimensions that it allows the handle 17 to rotate about the axis of the latch bolt 12 and to move in the longitudinal direction of the same so that the handle 17 can be manipulated freely to move the latch bolt 12. A pair of oppositely extending flanges 21 are formed on the housing 11 and have holes 22 for receiving screws or suitable fastening means (not shown) to secure the latch assembly 10 to a window sash or door. While the flanges 21 are shown for illustrative purposes to lie flush with the front housing wall 14, they may be provided at any other suitable positions on the housing 11.

According to an important aspect of the invention, there is provided a plate member 23 disposed within the housing 11 and adapted to shift in the direction in which the latch bolt 12 is slidable. The plate member 23 includes a horizontal web 24 located adjacent the housing wall 19 and having formed centrally therethrough a tapped aperture 25 for receiving a screw 26 through a slot 27 formed in the wall 19. The plate member 23 can be held in place within the housing 11 by tightening the screw 26 and its position relative to the housing 11 is adjustable by loosening the screw 26 and moving the latter together with the plate member 23 along and within the slot 27. The plate member 23 is also provided with a vertical web 28 extending at right angles to the horizontal web 24 and located adjacent the wall 20. The vertical web 28 has an extension 29 projecting in the longitudinal direction of the housing 11 and arranged along an edge 30 of the opening 18. The web extension 29 is partially cut away to provide engaging means or prongs 31 projecting upwardly beyond the edge 30 of the opening 18 and adapted for engagement with the handle 17 of the latch bolt 12. A coiled compression tension spring 32 is disposed around the latch bolt 12 to normally bias the latter rearwardly toward the right as viewed in FIG. 1, or toward an unlatched position and at the same time to normally bias the latch bolt 12 to rotate about its axis in the clockwise direction, or in a direction to cause the bolt handle 17 to engage with the engaging prongs 31. With this arrangement, the latch bolt 12 is projected and held in a selected position by engaging the bolt handle 17 with one of the engaging prongs 31. Importantly, the extent of the projection of the latch bolt 12 can be varied by shifting the plate member 23 longitudinally of the housing 11 with the screw 26 loosened and such extent of projection is locked by re-tightening the screw 26.

Figure 2:
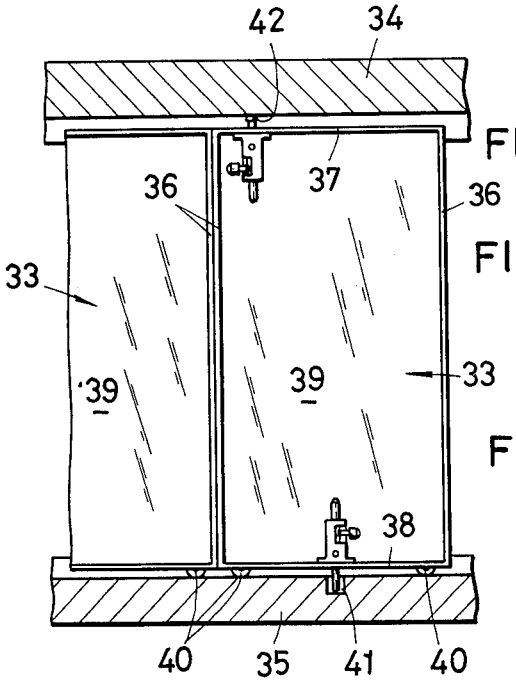
FIG. 2 is a front elevational view of sliding window sashes having latches mounted thereon of the type shown in FIG. 1.

FIG. 2 shows the manner in which the latch assembly 10 is used with sliding window sashes 33 disposed between a header 34 and a sill 35. As is conventional in the art, each sliding window sash 33 has a pair of vertical stiles 36, top and bottom rails 37 and 38, and a sheet of glass or a panel 39 held in place by these frame members. Rotatably mounted on the bottom rail 38 of the sashes 33 are a pair of rollers 40 for rolling engagement with the sill 35. The sill 35 has an upwardly opening recess 41 formed therein for receiving the front end 16 of the latch bolt 12. A latch assembly 10 is mounted on each of the top and bottom rails 37 and 38. The bolt projection of the latch 10 mounted on the bottom rail 38 can be varied in the manner already described so as to compensate for the distance between the bottom rail 38 and the sill 35 to provide the best latching action. The latch assembly 10 mounted on the top rail 37 may be used as an auxiliary one which is so arranged and set that the front end 16 of the latch bolt 12 can act against the header 34 when the latch bolt 12 is in its extended position. This auxiliary latch assembly 10 serves to maintain the window sash 33 in intimate contact with the adjacent window sash 33 and also prevents the window sash 33 from rattling. A suitable cap 42 of a plastics material, for example, may be attached to the front end 16 of the latch bolt 12 to protect the header 34 from being worn out or damaged by engagement with the latch bolt 12.

Figure 3:
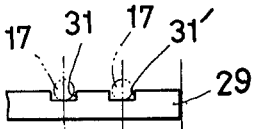
FIGS. 3 through 6 are schematic views illustrating a plate member having two engaging prongs in contrast to a plate member having one engaging prong.
Figure 4:
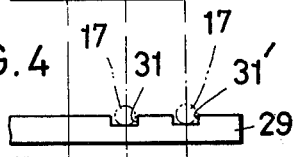
Figure 5:
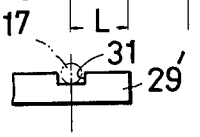
Figure 6:
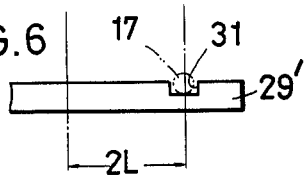

There should be provided two or more of these engaging prongs 31 of the plate member 23 for reasons given hereafter. Assuming that the distance between the two engaging prongs 31 and 31' is L as seen in FIGS. 3 and 4, when it is necessary to change the length of projection of the latch bolt 12 by a distance 2L, it will suffice for the plate member extension 29 to slide by the distance L since the distance between the engaging prong 31 shown in FIG. 3 and the engaging prong 31' shown in FIG. 4 becomes 2L. However, the plate member extension 29' shown in FIGS. 5 and 6 must be moved by the distance 2L to change the bolt projection by the distance 2L. Therefore, utilizing two or more engaging prongs 31 makes it possible to minimize the sliding movement of the plate member 23 and at the same time helps reduce the length of both the slot 27 in the housing 11 and the housing 11 proper. Advantageously, the bolt projection of the latch assembly 10 can be adjusted to any given gap or clearance between the bottom rail 38 and the sill 35 or between the top rail 37 and the header 34, which gap tends to vary little by little as these building components are susceptible to distortion and as the rollers 40 become worn.

What is claimed is

1. A latch for a closure member that is movable with respect to a frame member, said latch comprising:

a. a housing having mounting means by which it can be fixedly mounted on one of said members, said housing having a lateral opening, and said housing having an end wall with a hole disposed to face the other one of said members;

b. a latch bolt slidably supported in said housing and having one end extending through said hole for cooperation with said other one of said members;

c. a handle secured to said latch bolt and extending through said lateral opening with clearance to enable said latch bolt to be moved both along its axis and about its axis;

d. a plate member disposed within said housing and slidable in the direction of said latch bolt axis, there being engaging means on said plate member in registration with said lateral opening for engaging with said handle to hold said latch bolt in a selected locked position in which said one end of the latch bolt can cooperate with said other one of said members; and e. means selectably securing said plate member in a fixed position with respect to said housing.

2. A latch according to claim 1 in which said mounting means of said housing lies in a plane perpendicular to said latch bolt axis.

3. A latch according to claim 1 in which said securing means comprises a screw acting between said housing and said plate member.

4. A latch according to claim 3, said screw extending through a slot in the housing into a tapped aperture in said plate member, said slot being elongated in the direction of said latch bolt axis.

5. A latch according to claim 1 including a coiled compression-torsion spring disposed around said latch bolt and biasing said latch bolt to move in a direction away from said other one of said members, and also about its axis to urge said handle against said engaging means.

6. A latch according to claim 1, said engaging means comprising at least two prongs, whereby the range of movement of said plate member is minimized.

* * * * *